US005875642A

United States Patent [19]

Lee et al.

[11] Patent Number: 5,875,642

[45] Date of Patent: Mar. 2, 1999

[54] REFRIGERATOR FORMING AN AIR CURTAIN ACROSS AN OPENING WHEN A DOOR IS OPEN

[75] Inventors: Kyoung-Hoon Lee; Jin Yeol Jang; Sung-Kuen Lim; Sun-Guen Goh; Sung-Gwan Park; Jae-In Kim; Ho-Jae Byon, all of Suwon, Rep. of Korea

[73] Assignee: Samsung Electronics Co., Ltd., Suwon, Rep. of Korea

[21] Appl. No.: 873,769

[22] Filed: Jun. 12, 1997

[30] Foreign Application Priority Data

Jun. 12, 1996 [KR] Rep. of Korea ..... 1996 21104

[51] Int. Cl.[6] ..... F25D 17/08

[52] U.S. Cl. ..... 62/256; 62/408

[58] Field of Search ..... 454/193; 62/256, 62/408, 418

[56] References Cited

U.S. PATENT DOCUMENTS

| | | | |
|---|---|---|---|
| 4,058,989 | 11/1977 | Horvay et al. | 454/193 |
| 4,379,391 | 4/1983 | Rhee | 62/256 |
| 4,962,649 | 10/1990 | Battocletti | 62/256 |

FOREIGN PATENT DOCUMENTS

| | | |
|---|---|---|
| 56-12972 | 2/1981 | Japan . |
| 61-89782 | 6/1986 | Japan . |

*Primary Examiner*—William E. Tapolcai

*Attorney, Agent, or Firm*—Burns, Doane, Swecker & Mathis, L.L.P.

[57] ABSTRACT

A refrigerator includes a food storage space, an evaporator for generating cool air, and a fan for circulating the cool air to the storage space. An air diverting valve is provided which is movable in response to an opening of a door to the storage space for redirecting the air to form an air curtain across an opening of the storage space. The air diverting valve can be moved by a motor, or by a spring.

13 Claims, 13 Drawing Sheets

REFRIGERATOR FORMING AN AIR CURTAIN ACROSS AN OPENING WHEN A DOOR IS OPEN

BACKGROUND OF THE INVENTION (1) Field of the Invention

The present invention generally relates to a refrigerator, and more particularly, a refrigerator which is provided with an air curtain device for preventing the discharge of cool air when the door is open.

(2) Description of the Prior Art

A refrigerator maintains foodstuffs in a freezed or refrigerated state in order to prevent the deterioration of the foodstuffs' freshness and taste. The foodstuffs stored in the refrigerator's refrigerating compartment are cooled by cool air generated by the operation of the refrigerating cycle. At the front of the refrigerating compartment is formed an opening to which a door is attached to open and close the refrigerating compartment. Such a conventional refrigerator has a disadvantage in that the cool air in the compartment is released into the air when the door is open, thereby raising the temperature therein. This is caused by the pressure and temperature differences between the inside and outside of the compartment. This problem results in the decreased operating efficiency of the refrigerator and especially the deterioration of the foodstuffs' freshness and taste.

In order to resolve the above disadvantage, there has been disclosed a technique for preventing the discharge of cool air in the compartment by creating an air curtain across the opening of the compartment when the door is open. Examples of this arrangement are JP Patent Laid-Open Publication No. 56-12972 and JP Utility Model Laid-Open Publication No. 61-89782.

FIG. 12 shows a prior art disclosed in JP Patent Laid-Open Publication No. 56-12972. An air outlet 21 and air inlet 23 are provided at the front opening of the refrigerator body 11, an air passage 25 is provided along the inner walls 13,15,17 to connect the air outlet 21 with the air inlet 23, and a motorized fan 27 is installed in the air passage 25 and operates when the door 19 is open. Thus, when the door 19 is open, the motorized fan 27 operates to circulate cool air through the air passage 25, thereby creating an air curtain 29 over the front opening between the air inlet 21 and the air outlet 23. However, such a prior art for creating an air curtain has a disadvantage in that because it requires the additional motorized fan and air passage, the structure of a refrigerator with the air curtain device is unnecessarily complicated.

FIG. 13 shows another prior art disclosed in JP Utility Model Laid-Open Publication No. 61-89782. The inside space 5 extends into the machine compartment 4 which is provided at the top of the refrigerator and has a motorized fan 7 therein. Thus, cool air discharged by the motorized fan 7 collides with the inner front side 11 of the extending space 5, and is therefore redirected downward, thereby creating an air curtain over the opening 2.

However, as in the former prior art, this type of air curtain requires an additional motorized fan, thereby complicating the structure. Furthermore, it has another disadvantage in that the air curtain does not function properly because the cool air discharged by the motorized fan is circulated within the entire storage space, thereby forming the air curtain incompletely.

SUMMARY OF THE INVENTION

It is the objective of the present invention to provide a refrigerator equipped with an air curtain device of simple construction, which serves to insulate the inside of the refrigerator from the outside air when the door is open.

A refrigerator according to the present invention comprises a main body having a storage space provided with an opening through which foodstuffs is placed in or taken out of the storage space; a door for closing and opening said opening; cool-air generating means for cooling said storage space; a fan for forcedly circulating cool air in said storage space; and air curtaining means for creating an air curtain by directing the cool air discharged by said fan from one side of said opening to the opposite side of said opening.

An air circulating duct, which returns the cool air into said cool-air generating means via said storage space, is provided in said storage space. Said air curtaining means comprises an air curtaining duct branched from said air circulating duct and extending to the top portion of said opening, where the outlet of said air curtaining duct faces toward the bottom of said opening, and an opening/closing means for selectively opening or closing said air curtaining duct and air circulating duct in response to the opening and closing of said door, which is provided between said air curtaining duct and said air circulating duct.

Said opening/closing means comprises a valve member which is swung with a rotating shaft provided at one end thereof in order to selectively open or close said air curtaining duct and air circulating duct, and a motor for rotating said rotating shaft in response to the opening and closing of said door.

According to another embodiment of this invention, a duct provided in said storage space, is comprised of: an inlet and outlet which face downward and forward, respectively; a first passage extending from said outlet to said opening; a second passage extending from said opening to said inlet, a plurality of air discharging holes being formed on the top and side surfaces of said second passage; and an air curtaining port provided at the top of the opening where said first and second passages connect. Said air curtaining means includes a valve member which is pushed by said door to close said air curtaining port when said door is closed, and is swung about one side thereof to open said air curtaining port when said door is open.

A rotating shaft, which rotates the valve member, is joined to the top side of said valve member, and a spring is fitted to said rotating shaft to exert elastic force on said valve member.

A projection is attached to the inner surface of said door contacting said valve member to close said valve member when said door is closed, and a plurality of holes are formed on said valve member.

BRIEF DESCRIPTION OF THE DRAWINGS

In the accompanying drawings:

FIG. 2 illustrates the position of a valve member when the door is closed and FIG. 3 illustrates the position of the valve member when the door is open;

FIG. 4 illustrates the position of a valve member when the door is closed FIG. 5 illustrates the position of the valve member when the door is open;

FIG. 7 illustrates the position of a valve member when the door is closed and FIG. 8 illustrates the position of the valve member when the door is open;

FIG. 9 illustrates the position of a valve member when the door is closed and FIG. 10 illustrates the position of the valve member when the door is open;

DETAILED DESCRIPTION OF THE PREFERRED EMBODIMENTS

The preferred embodiments of the present invention will be now described in detail with reference to the accompanying drawings.

Figure 1:
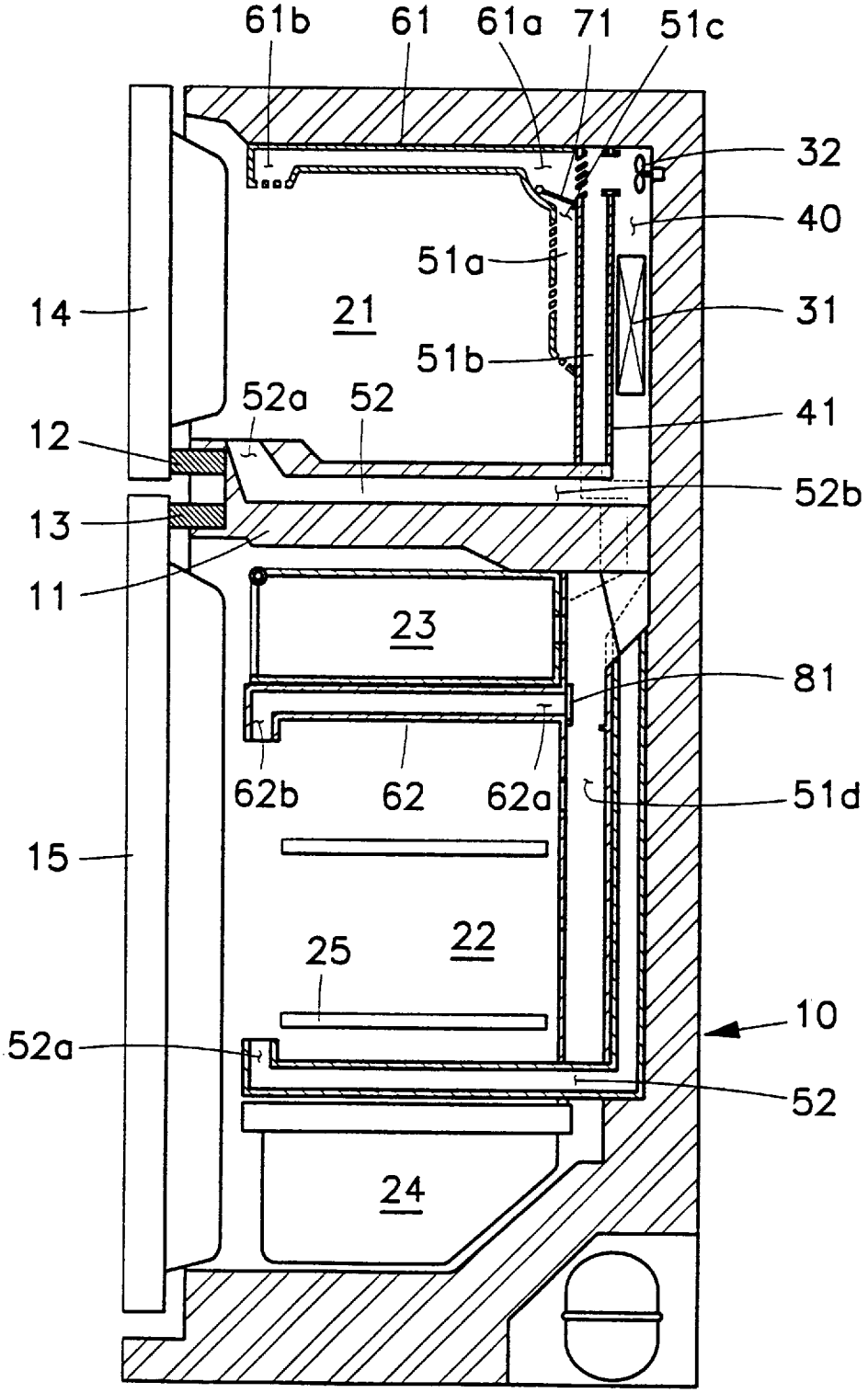
FIG. 1 is a longitudinal cross-sectional view showing the inner structure of a refrigerator according to the first embodiment of the present invention.

FIG. 1 is a longitudinal cross-sectional view showing the inner structure of a refrigerator according to the first embodiment of the present invention.

The inventive refrigerator includes a main body 10, storing compartments 21,22 provided inside the main body 10, doors 14,15 for opening and closing the storing compartments 21,22, respectively, and an evaporator 31 for cooling the storing compartments 21,22. The front sides of the storing compartments 21,22 are open to allow foodstuffs to be taken in and out. The storing compartments 21,22 are separated from each other by means of a partition 11 to allow them to maintain different temperatures, thereby serving as a freezing compartment and a refrigerating compartment, respectively. A special storing box 23, which is used for storing meat and fish below approximately 0° C., is provided at the upper portion of the refrigerating compartment 22, a vegetable box 24 for storing vegetables and fruits is provided at the lower portion of the refrigerating compartment 22, and a plurality of shelves 25 are provided between the special storing box 23 and the vegetable box 24. Button-type micro-switches 12,13 are attached to the front side of the partition 11 in order to sense the door 14 for the freezing compartment 21 and the door 15 for the refrigerating compartment 22 being open or closed, respectively.

The evaporator 31 is installed in a cooling space 40 which is provided in the rear of the freezing compartment 21, and shielded by a cover 41. At the upper portion of the cooling space 40 is installed a fan 32 for forcedly discharging the cool air generated by the evaporator 31, and at the backs of the freezing compartment 21 and refrigerating compartment 22 are mounted discharging ducts 51*a*, 51*b* and returning ducts 52 for guiding the discharged cool air that circulates in the compartments 21,22 and the evaporator 31. The discharging ducts 51*a*, 51*b* discharge cool air into the freezing compartment 21 and the refrigerating compartment 22, respectively, and the returning ducts 52 return the circulated cool air in the compartments 21,22 into the evaporator 31. The discharging ducts 51*a*, 51*b* communicate with the upper end of the cooling space 40, While the returning ducts 52 are provided inside the partition 11 and at the lower portion of the refrigerating compartment 22. The inlets 52*a* of the returning ducts 52 are positioned at the front of the compartments 21,22, and their outlets 52*b* communicate with the lower end of the cooling space 40.

Air curtain devices, which are characteristic of the present invention, are provided in the freezing compartment 21 and refrigerating compartment 22 to create an air curtain which prevents the outside air in a higher temperature from entering into the compartments 21,22 when the doors 14,15 are open. The air curtain device for the freezing compartment 21 comprises an air curtaining duct 61, which has an inlet 61*a* communicating with the discharging duct 51*a* and an outlet 61*b* located at the opening of the compartment 21, provided at the top of the compartment 21, and an air diverting member in the form of a valve member 71 provided at the inlet 61*a* to open or close the air curtaining duct 61 in accordance with the opening or closing of the door 14. In the same manner, the air curtain device for the refrigerating compartment 22 comprises an air curtaining duct 62, which has an inlet 62*a* communicating with the discharging duct 51*b* and an outlet 62*b* located at the opening of the compartment 22, provided at the bottom of the special storing box 23, and an air diverting member in the form of a valve member 81 provided at the inlet 62*a* to open or close the air curtaining duct 62 in accordance with the opening or closing of the door 15. The outlets 61*b*, 62*b* of the air curtaining ducts 61,62 extend downward to face the inlets 52 of the returning ducts 52, so that cool air flows from the top of the openings to the bottom, thereby forming air curtains.

Figure 2:
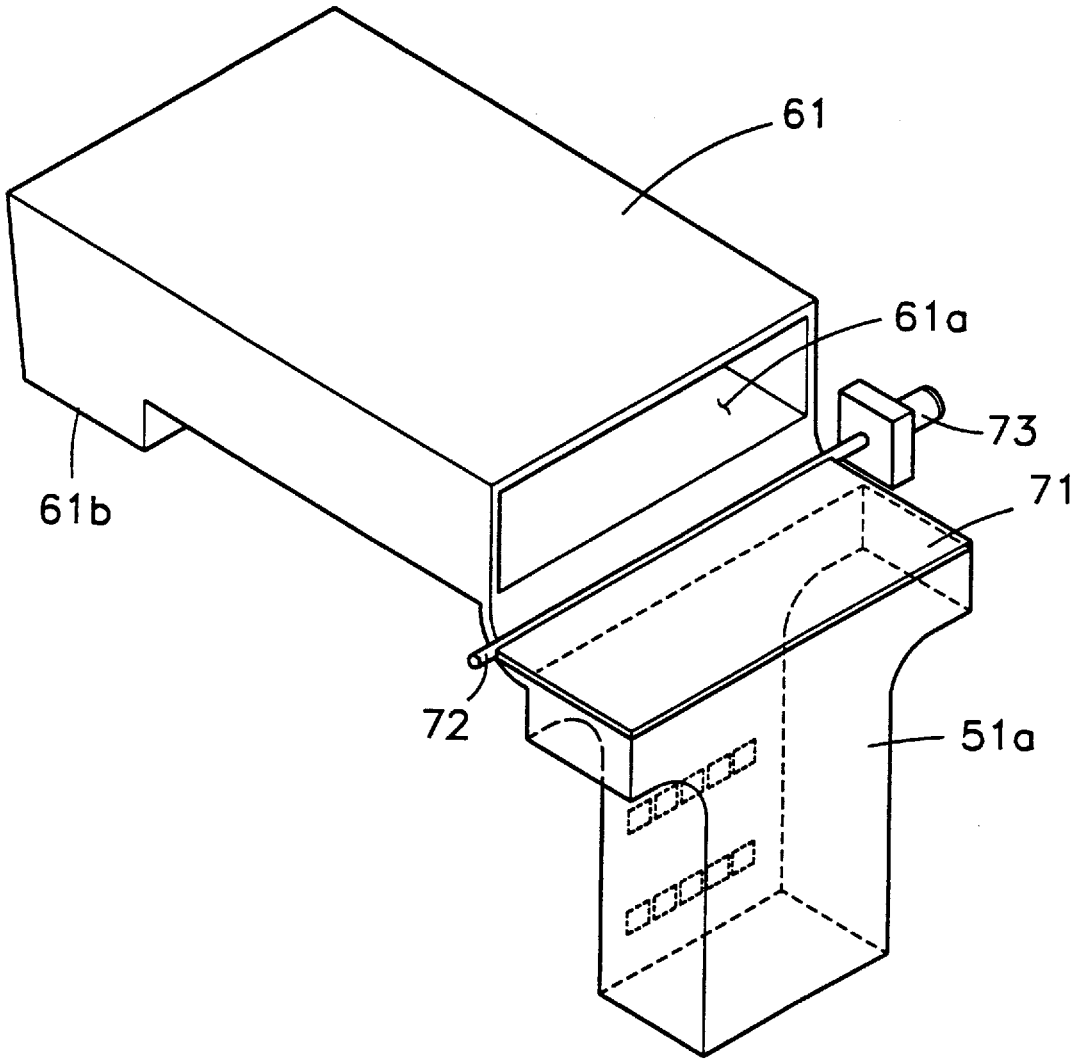
FIGS. 2 and 3 are perspective views showing the air curtain structure for the freezing compartment in FIG. 1, where

The air curtain structure for the freezing compartment 21 will be now described in detail with reference to FIGS. 2 and 3. The air curtaining duct 61, which extends from the rear wall to the opening of the freezing compartment 21, is shaped as a hollow rectangular box. The inlet 61*a* of the air curtaining duct 61 faces the inlet 51*c* (FIG. 3) of the discharging duct 51*a*. The valve member 71 is mounted on the rotating shaft 72, which is provided at the contact point between the air curtaining duct 61 and discharging duct 51*a*. A motor 73 is connected to one end of the rotating shaft 72, which rotates the rotating shaft 72 in the forward or reverse direction in accordance with the opening and closing of the door 14. Thus, the valve member 71 is rotated to selectively open or close the respective ducts 51*a*, 61.

Figure 4:
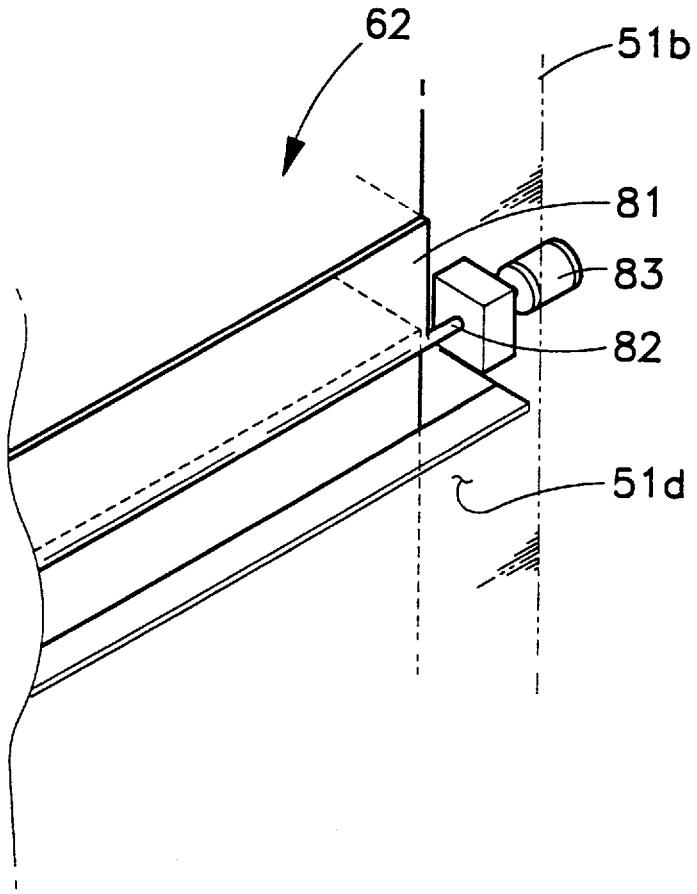
FIGS. 4 and 5 are perspective views showing the air curtain structure for the refrigerating compartment in FIG. 1, where
Figure 5:
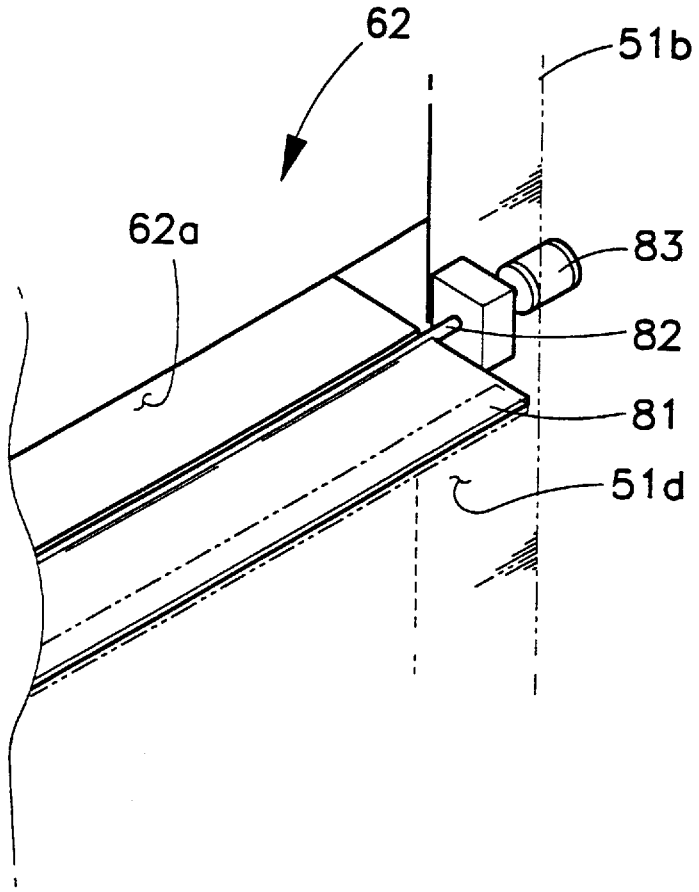

In the same manner, the air curtain device for the refrigerating compartment 22, as shown in FIGS. 4 and 5, comprises a valve member 81, which is mounted on a rotating shaft 82, which is provided at the contact point between the air curtaining duct 62 and discharging duct 51*b*, and a motor 83 for rotating the valve member 81.

The motors 73,83 operate when the freezing compartment door 14 or the refrigerating compartment door 15 is open or closed, respectively. That is, when the doors 14,15 are opened, the valve members 71,81 are rotated clockwise by the motors 73,83 to open the air curtaining ducts 61,62 and close the discharging ducts 51*a*, 51*b*. On the other hand, when the doors 14,15 are closed, the valve members 71,81 are rotated counterclockwise to open the discharging ducts 51*a*, 51*b* and close the air curtaining ducts 61,62.

The operation of the inventive air curtain devices will be now described in more detail.

When the doors 14,15 are closed, the inlet 51*c*,51*d* of the discharging ducts 51*a*, 51*b* are opened and the inlets 61*a*,62*a* of the air curtaining ducts 61,62 are closed by means of the valve members 71,81. Thus, the cool air generated by the evaporator 31 is discharged into the freezing and refrigerating compartments 21 and 22 via the discharging ducts 51*a*, 51*b* by means of the fan 32 and then returned to the evaporator 31 via the returning ducts 52, thereby cooling the freezing and refrigerating compartments 21 and 22.

Figure 3:
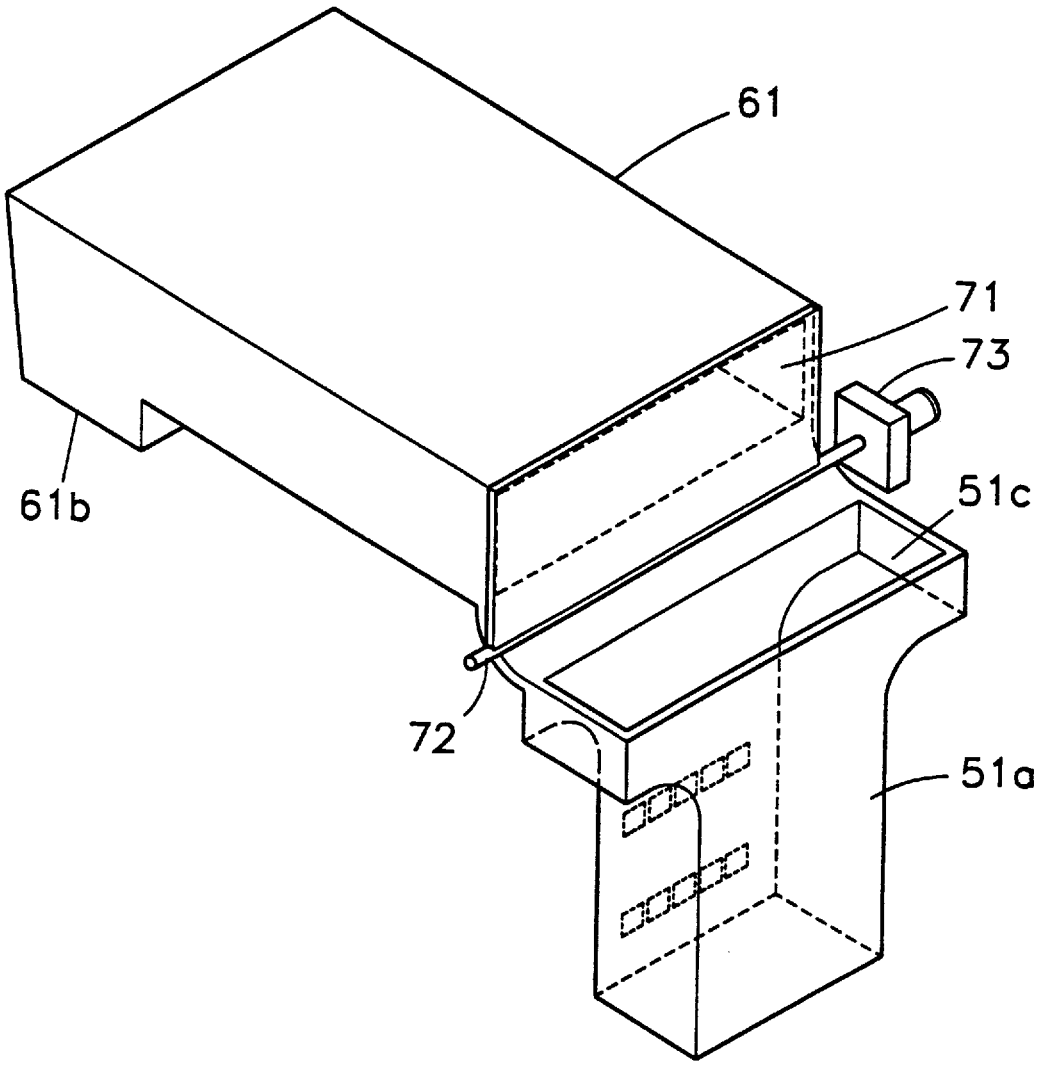

When the user opens the freezing compartment door 14 to take foodstuffs in or out of the freezing compartment 21, the motor 73 operates to rotate the valve member 71 counterclockwise, so that the inlet 61*a* of the air curtaining duct 61 is opened and the inlet 51*c* of the discharging duct 51*a* for the freezing compartment 21 (FIG. 3). Accordingly, the cool air discharged by the fan 32 flows along the air curtaining duct 61 and then is discharged toward the bottom of the opening of the freezing compartment 21, thereby forming an air curtain for preventing the outside air from entering into the compartment 21. The discharged air is returned into the evaporator 31 via the returning duct 52.

When the user opens the refrigerating compartment door 15 to take foodstuffs in or out of the refrigerating compartment 22, the motor 83 operates to rotate the valve member 81 counterclockwise, so that the inlet 62*a* of the air curtaining duct 62 is opened and the inlet 51*d* of the discharging duct 51*b* for the refrigerating compartment 22 is closed (FIG. 5). Accordingly, the cool air discharged by the fan 32 flows along the air curtaining duct 62 and then is discharged toward the bottom of the opening of the refrigerating compartment 22, thereby forming an air curtain for preventing the outside air from entering into the compartment 22. The discharged air is returned into the evaporator 31 via the returning duct 52.

In the aforementioned processes, the opening and closing of the doors 14,15 is sensed by the micro-switches 12,13 provided at the front side of the partition 11.

Figure 6:
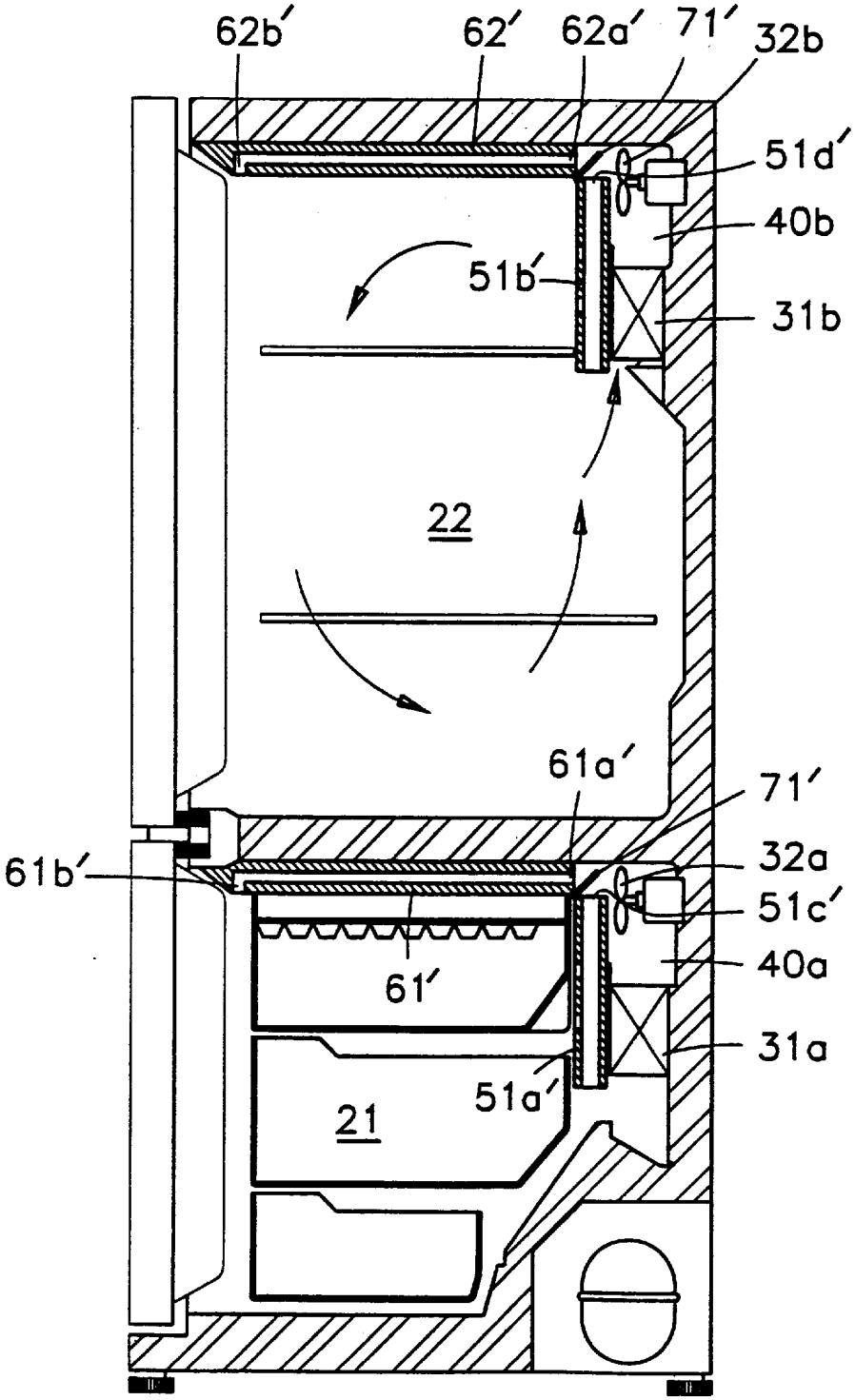
FIG. 6 is a longitudinal cross-sectional view showing a refrigerator according to the second embodiment of the present invention.

FIG. 6 shows the inner structure of a refrigerator according to the second embodiment of this invention, in which the freezing compartment 21 and the refrigerating compartment 22 are cooled by means of independent evaporators and fans. As shown in the figure, at the rear side of the freezing compartment 21 is provided a cooling space 40*a* in which an evaporator 31*a* and a fan 32*a* are mounted. A discharging duct 51*a*' is provided at the front of the cooling space 40*a* to evenly discharge the cool air into the freezing compartment 21. The lower end of the cooling space 40*a* is opened in order that the cool air circulated in the freezing compartment 21 is drawn through the evaporator 31*a* by the fan 32*a*. In the same manner, a discharging duct 51*b*' is provided at the front of the cooling space 40*b* and the lower end of the cooling space 40*a* is opened. Air curtaining ducts 61',62' are provided at the tops of the freezing and refrigerating compartments 21 and 22, respectively.

Figure 7:
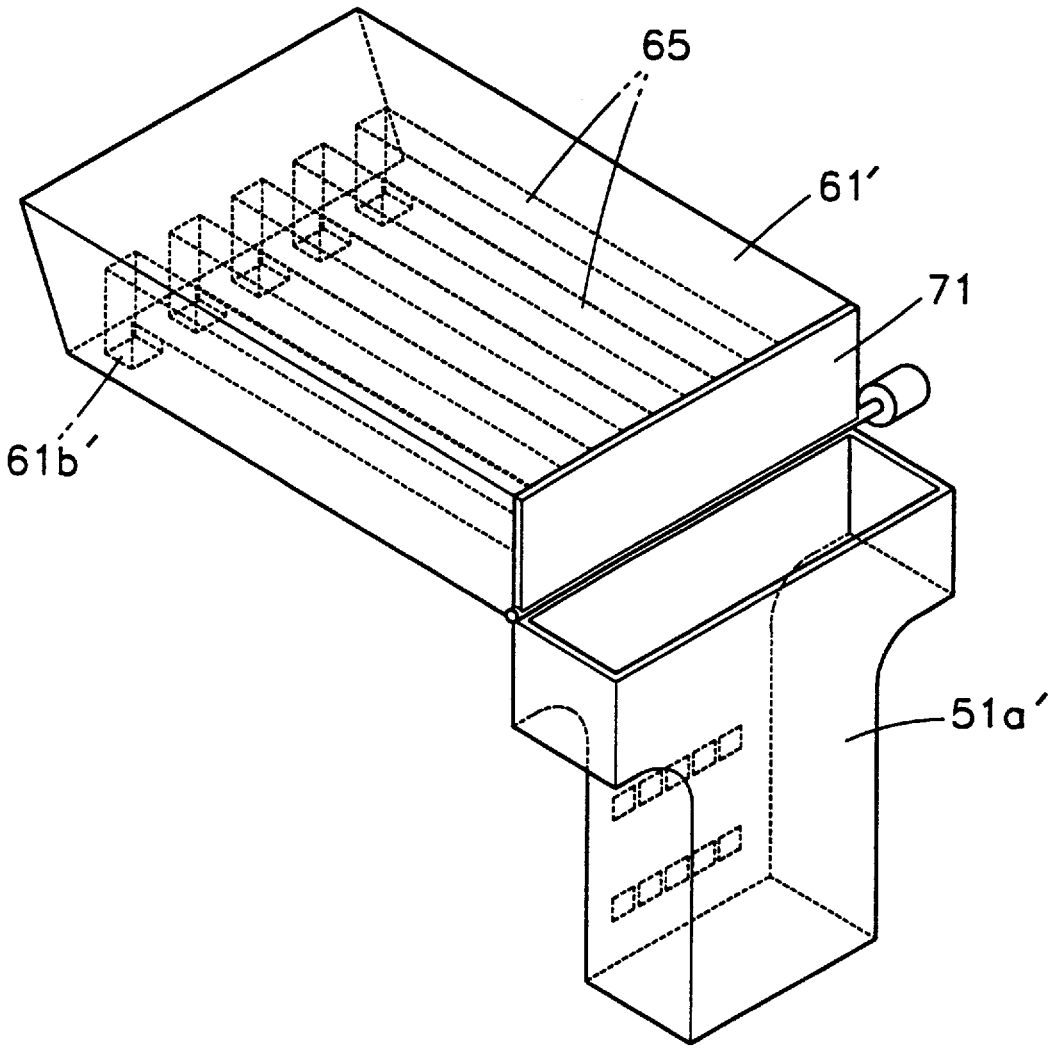
FIGS. 7 and 8 are perspective views showing the air curtain structure in FIG. 6, where
Figure 8:
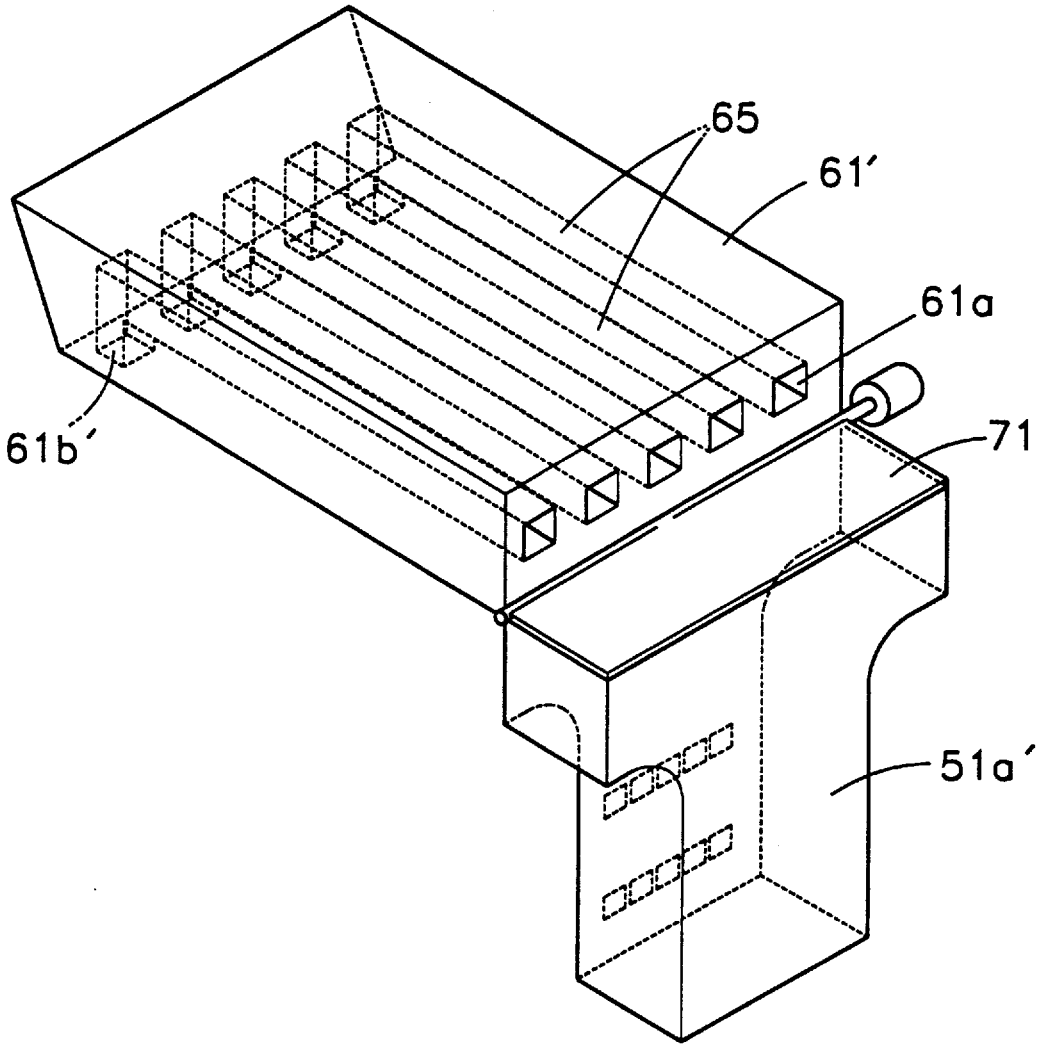

The air curtaining ducts 61' and 62' have the same structure, and therefore only the air curtaining duct 61' in the freezing compartment 21 will be described with reference to FIGS. 7 and 8. The inlet 61*a*' of the air curtaining duct 61' communicates with the inlet 51*c*' of the discharging duct 51*a*' and its outlet 61*b*' lies facing downward at the opening of the freezing compartment 21. An air diverting member in the form of a valve member 71', which is identical with that in FIG. 2, is mounted between the inlet 61*a*' of the air curtaining duct 61' and the inlet 51*c*' of the discharging duct 51*a*'. In this embodiment, the air curtaining duct 61 has a plurality of air passages 65 so that the discharged air is evenly distributed across the opening of the compartment 21.

Figure 9:
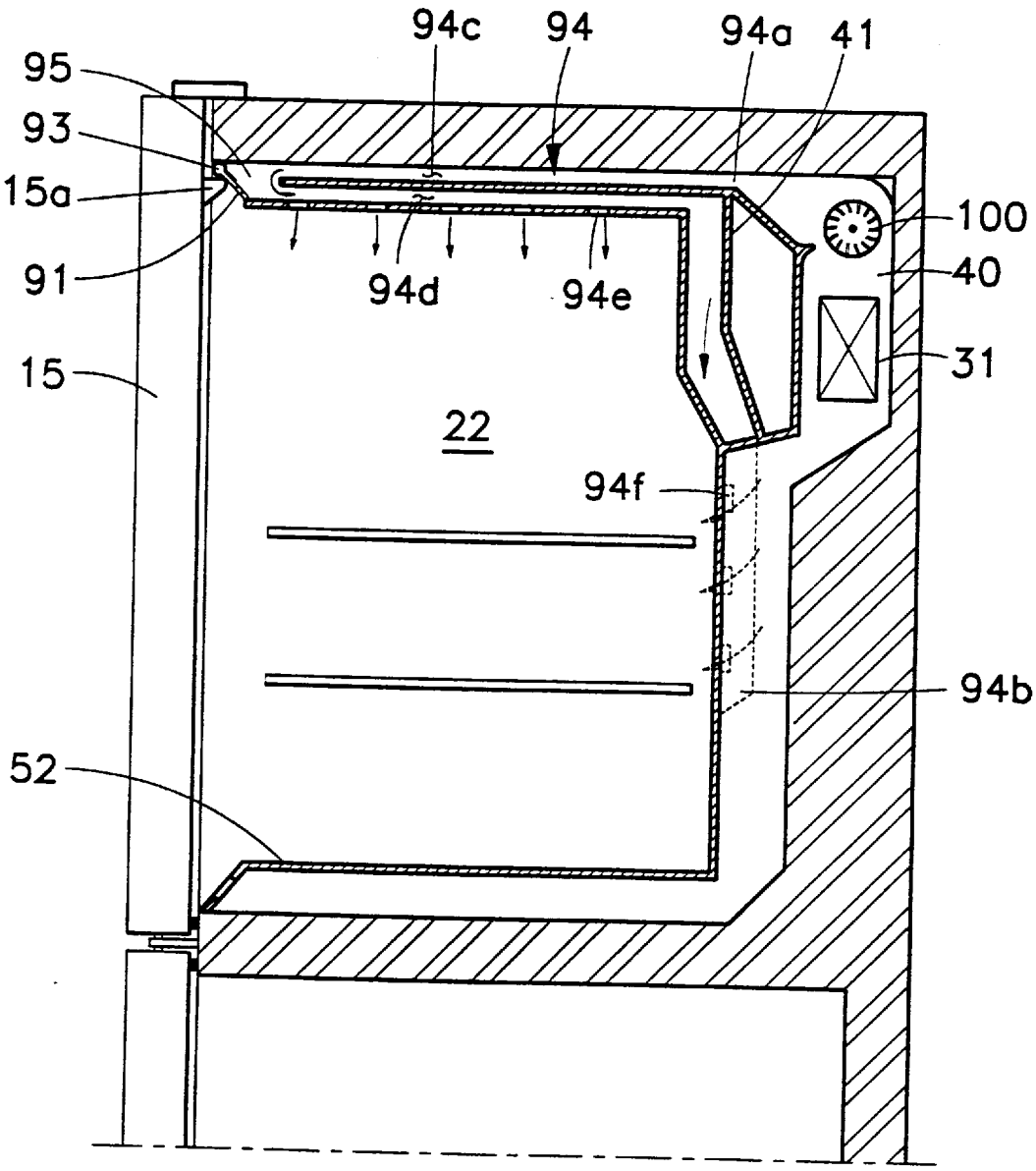
FIGS. 9 and 10 are longitudinal cross-sectional views showing a refrigerator according to the third embodiment of the present invention, where
Figure 10:
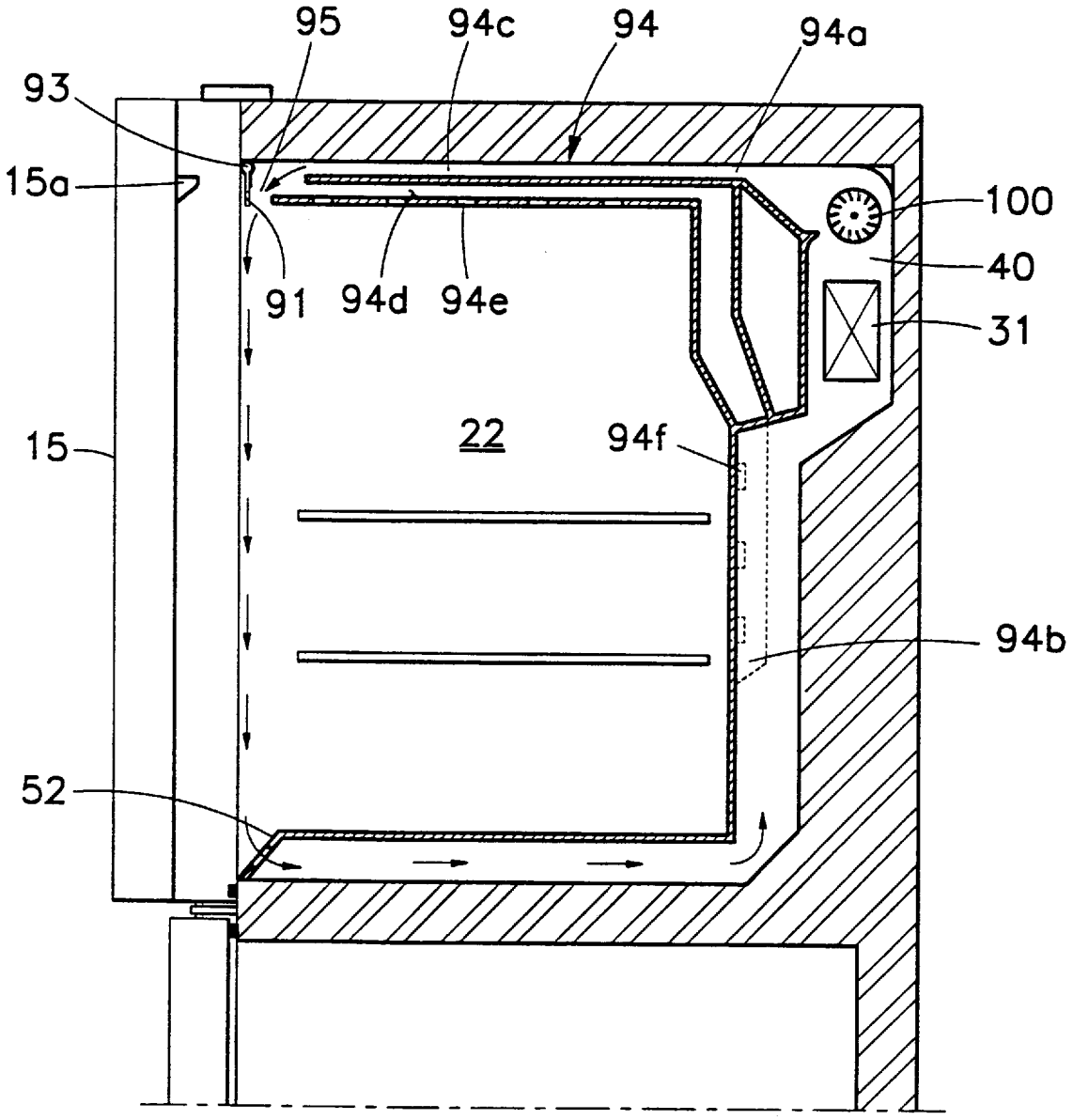

FIGS. 9 and 10 show the inner structure of a refrigerator according to the third embodiment of this invention, in which the duct for circulating the cool air and the duct for creating the air curtain are integrally formed.

A duct 94 for guiding cool air has a first passage 94*c* which extends from the upper portion of the cooling space 40 to the opening of the storing compartment 22 and a second passage 94*d* which extends from the opening of the storing compartment 22 to the cover 41, where it is bent downward. The inlet of the first passage 94*c* and the outlet of the second passage 94*d* are used as the inlet 94*a* and outlet 94*b* of the duct 94 so that the cool air generated by the evaporator 31 is discharged into the storing compartment 22 through the duct 94. In order that the cool air is discharged from the top and rear of the storing compartment 22, a plurality of holes 94*e* are formed on the second passage 94*d* which is arranged over the ceiling and back of the storing compartment 22.

A discharging port 95 which creates the air curtain is formed at the top of the opening where the first and second passages 94*c* and 94*d* connect, and a valve member 91, which is operated by the closing and an air diverting member in the form of opening of the door 15, covers the discharging port 95. On the inner top of the door 15 is attached a projection 15*a* which pushes the valve member 91 inward to close the discharging port 95 when the door 15 is closed.

Figure 11:
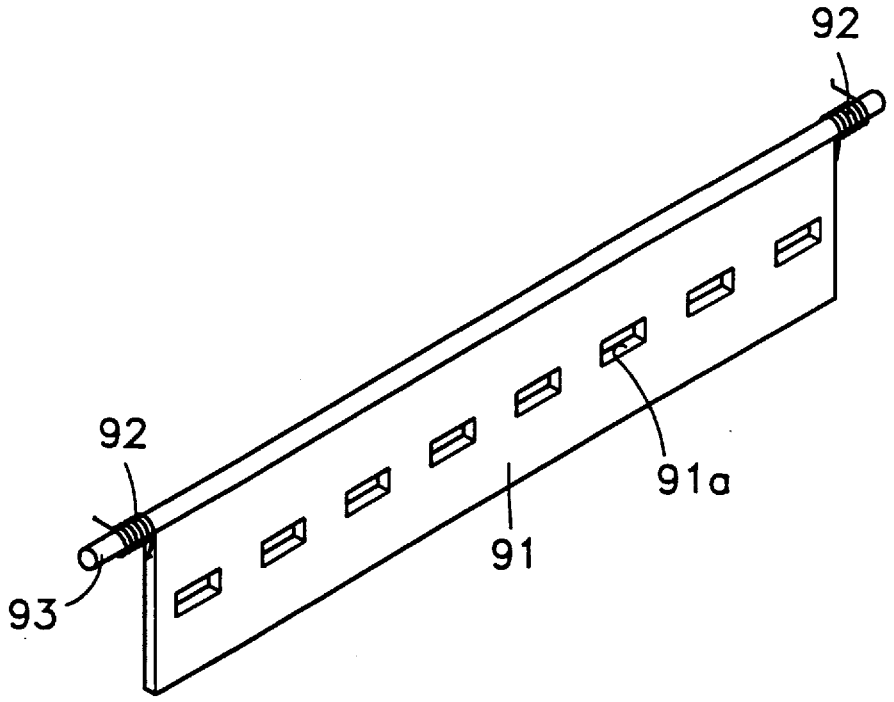
FIG. 11 is a perspective view showing the valve member in FIGS. 9 and 10.
Figure 12:
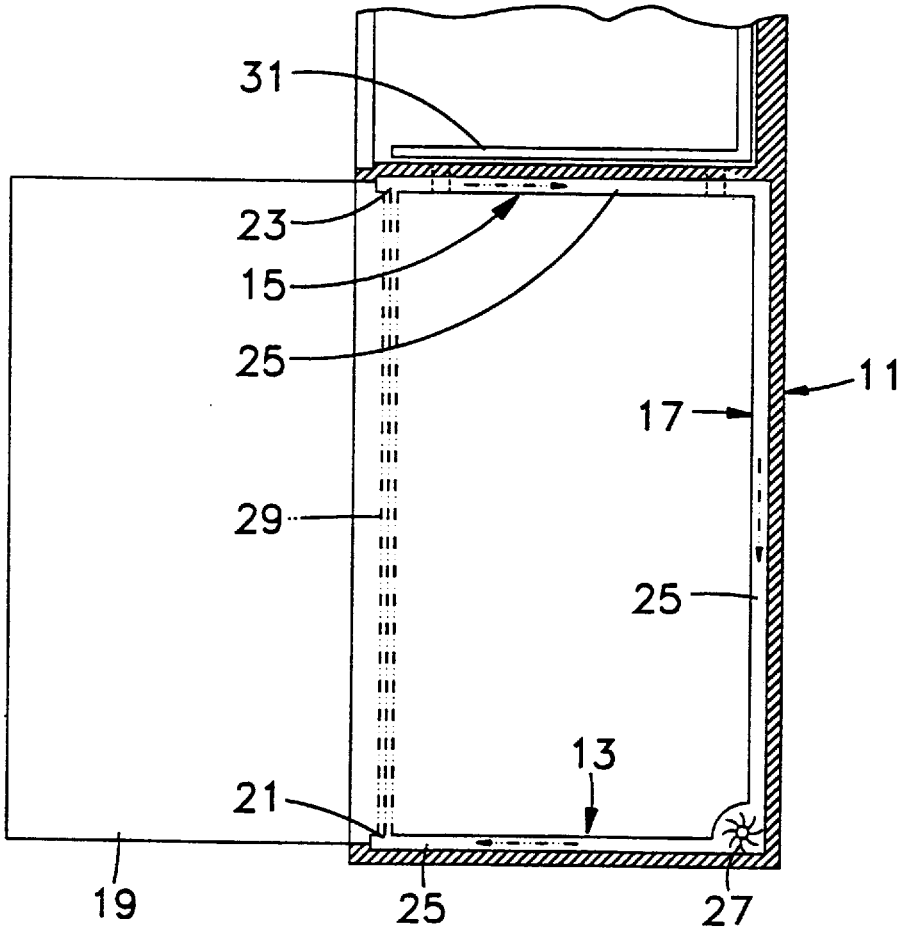
FIG. 12 (PRIOR ART)
FIGS. 12 and 13 are longitudinal cross-sectional views showing a refrigerator according to a prior art.
Figure 13:
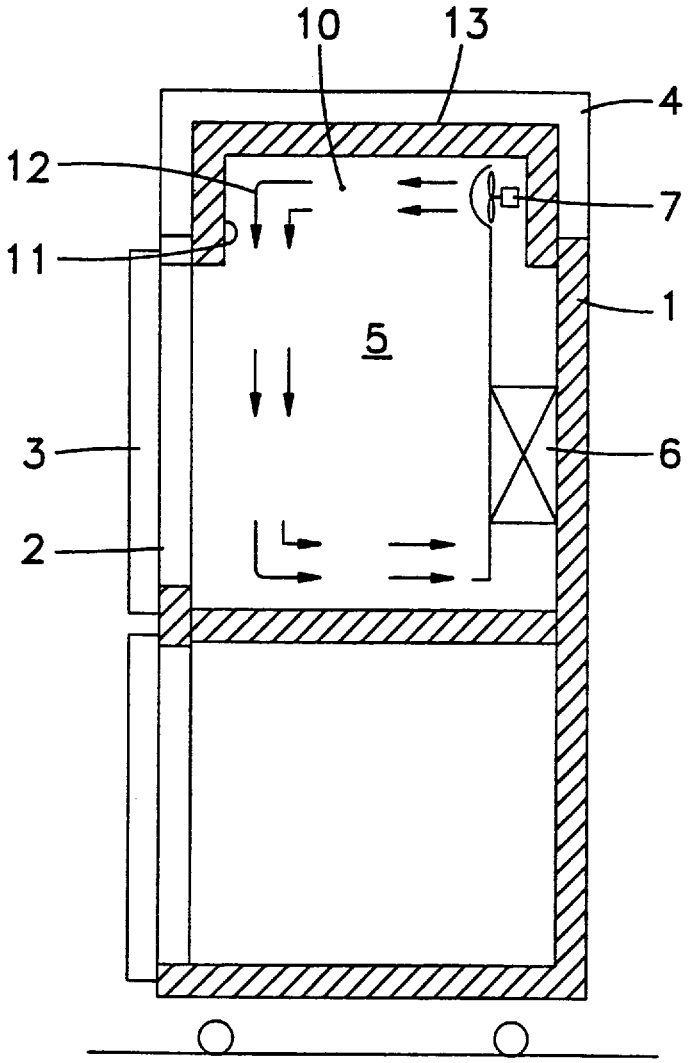
FIG. 13 (PRIOR ART)

As shown in FIG. 11, the valve member 91, which is formed of a plate member, has a rotating shaft 93 at its upper end, and its lower end extends downward to cover the discharging port 95. In order that the discharging port 95 is quickly opened with the opening of the door 15 to promptly create the air curtain, springs 92 are mounted on both ends of the rotating shaft 93 in such a manner that their elastic force places the valve member 91 in a vertical position. A plurality of holes 91*a* are formed on the valve member 91 to discharge cool air from the front side of the storing compartment 22 when the door 15 is closed, thereby helping to maintain a uniform temperature in the storing compartment 22. It is preferable that the fan 32' is a sirocco fan that has the same width as that of the duct 95, to thereby provide cool air evenly over the entire width of the duct 94.

The operation of the air curtain device according to the third embodiment will be now described in detail with reference to FIGS. 9 and 10.

As shown in FIG. 9, when the door 15 is closed, the valve member 91 is pushed upward by the projection 15*a* formed on the door 15 to thereby close the discharging port 95. Thus, the cool air generated by the evaporator 31 is forced to flow along the first and second passages 94*c*,94*d* from the inlet 94*a* of the duct 94. A portion of the cool air is discharged through the holes 94*e* of the second passage 94*d*, while the rest is discharged through the holes 94*f* of the second passage 94*d* and the outlet 94*b* into the storing compartment 22. The cool air then circulates in the storing compartment 22 and returns to the evaporator 31 through the returning duct 52. In the above circulation, a little of the cool air is also discharged into the front side of the storing compartment 22 through the holes 91*a* formed on the valve member 91 (FIG. 11). Accordingly, the entire storing compartment 22 is uniformly cooled because the cool air is discharged from the upper, rear and front portions.

As shown in FIG. 10, when the door 15 is open, the valve member 91 is swung forward by the elastic force of the springs 91 to thereby open the discharging port 95. Thus, a large portion of the cool air sent by the fan 32' is discharged through the discharging port 95 to thereby create an air curtain. At this time, the valve member 91 is vertically positioned at the front side of the discharging port 95 so as to redirect the cool air downward.

As aforementioned, the advantages of a refrigerator according to this invention lie in the fact that the air curtain devices are of a simple installation structure, and the installation cost can be reduced because the air curtain devices are made by utilizing the existing cool-air circulating duct and fan.

What is claimed is:

1. A refrigerator comprising:

a main body having a storage space provided with an opening through which foodstuffs are inserted or removed;

a door for closing and opening the opening;

cool-air generating means for generating cool air;

a fan for forcedly circulating the cool air throughout said storage space when the door is closed; and an air diverting valve movable to a position in response to an opening of the door, for causing air from the fan to be directed from one side of the opening to an opposite side thereof and thereby form an air curtain across the opening.

2. The refrigerator according to claim 1 wherein there is a first duct for directing cool air generally into the storage space, and a second duct branched from the first duct for being opened by the air diverting valve for creating the air curtain.

3. The refrigerator according to claim 1 wherein the valve rotatable is about an axis.

4. The refrigerator according to claim 3 further including a motor for rotating the valve.

5. The refrigerator according to claim 1 further comprising a first duct extending upwardly at a rear portion of the storage space, and a second duct extending horizontally; the first duct including an inlet at its upper end and an outlet at its lower end, the outlet communicating with the storage space; the second duct including an inlet disposed adjacent the inlet of the first duct, and an outlet for directing the curtain of air downwardly; the fan arranged to direct cool air toward both inlets; the air diverting valve situated between the two inlets for selectively diverting air toward one of the inlets.

6. The refrigerator according to claim 5 wherein the outlet of the second duct includes horizontally spaced holes.

7. The refrigerator according to claim 1 wherein the air diverting valve is biased to a position for diverting air to an air curtain-forming state and is pushed out of that position by the door when the door is closed.

8. The refrigerator according to claim 7 further including a spring for biasing the air diverting member to the position for diverting air to the air curtain-forming state.

9. The refrigerator according to claim 7 wherein the air diverting member includes a plurality of holes formed therein for conducting cool air therethrough when the door is closed.

10. The refrigerator according to claim 1 wherein the main body includes an additional storage space having an additional door, and an additional air diverting valve movable to a position in response to an opening of the additional door for causing an air curtain to be formed across an opening of the additional storage space.

11. The refrigerator according to claim 10 wherein the fan circulates cool air to both of the storage spaces.

12. The refrigerator according to claim 10 further including an additional cool air generating means and an additional fan for circulating cool air generating means to the second storage space.

13. A refrigerator comprising:

a main body having a storage space provided with an opening through which foodstuffs are inserted or removed;

a door for closing and opening the opening;

cool-air generating means for generating cool air;

a fan for forcedly circulating the cool air;

a ducting including a first outlet arrangement for directing cool air into the storage space for regulating a temperature therein, and a second outlet arrangement for directing air from one side of the opening to an opposite side thereof and thereby form an air curtain across the opening; and an air diverting member disposed in the ducting for movement in response to the door being opened and closed;

the air diverting member being movable to a first position in response to the door being closed, for admitting cool air flow to the first outlet arrangement and obstructing cool air flow to the second outlet arrangement;

the air diverting member being movable to a second position in response to the door being opened, for admitting cool air flow to the second outlet arrangement and obstructing cool air flow to the first outlet arrangement.

* * * * *